US006839921B2

(12) United States Patent
Cloutier et al.

(10) Patent No.: US 6,839,921 B2
(45) Date of Patent: Jan. 11, 2005

(54) PORTABLE ANCHORABLE BEACH TOWEL APPARATUS

(76) Inventors: Robert Cloutier, #15 Lisa Dr., Windham, ME (US) 04062; Louiselle Cloutier, 344 10 Rue Quest, La Guadeloupe (CA), 60M 1G0

( * ) Notice: Subject to any disclaimer, the term of this patent is extended or adjusted under 35 U.S.C. 154(b) by 0 days.

(21) Appl. No.: 10/448,380

(22) Filed: May 30, 2003

(65) Prior Publication Data

US 2004/0237193 A1 Dec. 2, 2004

(51) Int. Cl.[7] ..... A47G 9/06
(52) U.S. Cl. ..... 5/417; 5/419
(58) Field of Search ..... 5/417–420

(56) References Cited

U.S. PATENT DOCUMENTS

| | | | | |
|---|---|---|---|---|
| 1,222,563 | A | | 4/1917 | Rosenberg |
| 2,898,609 | A | | 8/1959 | Storie |
| 3,689,947 | A | | 9/1972 | Wolf |
| 4,195,378 | A | | 4/1980 | Parker |
| 4,546,507 | A | | 10/1985 | Weinstein |
| 4,634,618 | A | | 1/1987 | Greer et al. |
| D322,532 | S | | 12/1991 | Kumar et al. |
| 5,072,467 | A | | 12/1991 | Hunt |
| 5,081,727 | A | | 1/1992 | Ippolito |
| 5,101,525 | A | | 4/1992 | Ippolito |
| 5,361,435 | A | | 11/1994 | Reeves |
| 5,467,487 | A | | 11/1995 | Sicard |
| 5,524,309 | A | | 6/1996 | La Barbera |
| 5,535,461 | A | | 7/1996 | Schwender |
| 5,622,300 | A | * | 4/1997 | Robinson ..... 224/575 |
| 5,629,071 | A | | 5/1997 | Feldman |
| 5,644,807 | A | | 7/1997 | Battistella |
| 5,729,846 | A | | 3/1998 | Sullivan |
| 5,740,566 | A | * | 4/1998 | Stacy ..... 5/420 |
| 5,774,912 | A | | 7/1998 | Dominique |
| 6,182,309 | B1 | | 2/2001 | Sullivan |
| 6,192,536 | B1 | | 2/2001 | Connors |
| 2003/0141205 | A1 | * | 7/2003 | Cabatic et al. ..... 206/305 |
| 2004/0038842 | A1 | * | 2/2004 | Fagg et al. ..... 510/295 |

* cited by examiner

*Primary Examiner*—Teri Pham Luu
(74) *Attorney, Agent, or Firm*—John J. Welch Jr., Esq.

(57) ABSTRACT

A foldable towel with a hole in each corner thereof for receipt of anchoring pins and with strapping loops sewn thereto for receipt of strapping wrapable about the towel and conjoined by affixation means located at the respective ends of each piece of strapping to facilitate portability and further characterized by the presence of pockets sewn thereto to on the one hand house a pillow and on the other hand house the pins when the towel is not in use.

8 Claims, 7 Drawing Sheets

PORTABLE ANCHORABLE BEACH TOWEL APPARATUS

CROSS REFERENCES TO PRIOR OR PARENT APPLICATIONS

The instant invention does not relate to, nor has it been described in any prior or parent applications.

FEDERALLY SPONSORED RESEARCH AND DEVELOPMENT

The instant invention has not been the subject of any federally sponsored research and development.

BACKGROUND OF THE INVENTION

1. Field of the Invention

The instant invention relates to that field of devices that encompasses portable and anchorable towels and blankets.

2. Previous Art

The art reflected in the accompanying Informational Art Statement does not anticipate nor does it refer to or teach the instant invention.

SUMMARY OF THE INVENTION

1. A Brief Description of the Invention

The instant invention consists of a foldable towel with holes in each of the corners thereof for receipt of pins to anchor it in sand. It also strapping loops through which closeable strapping is threaded to facilitate portability thereof. Finally, it is further characterized by the presence of pockets sewn thereto serving to, on the one hand house a pillow and on the other hand store the abovementioned pins when not in use.

2. Object of the Invention

The purpose of the instant invention is to provide beachgoers with a readily portable beach towel that they can anchor to sand so as to prevent it from wrinkling up when persons get up from lying on it and so as to obviate the possibility that it could perhaps be blown about on a windy day. The invention moreover comes with a pillow unit so as to also aid in the comfort of a beachgoer wishing to lie in the sun atop the unfolded and anchored towel. It is the ready portability of the invention coupled with a ready responsiveness to personal comfort and convenience on a beach that respectfully submitted, renders the invention indeed new, useful and unique.

A BRIEF DESCRIPTION OF THE DRAWINGS

Figure 1:
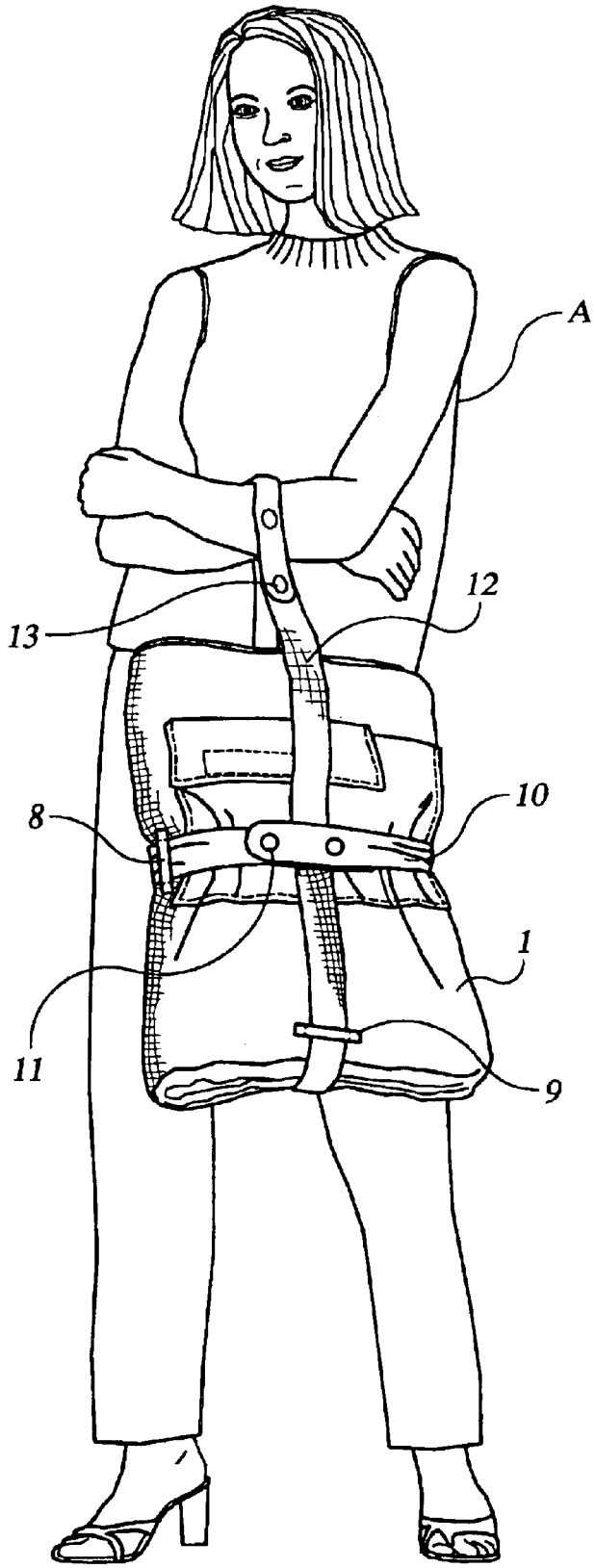

1. FIG. 1 shows the intact invention in a wholly folded state being carried by a person.

Figure 2:
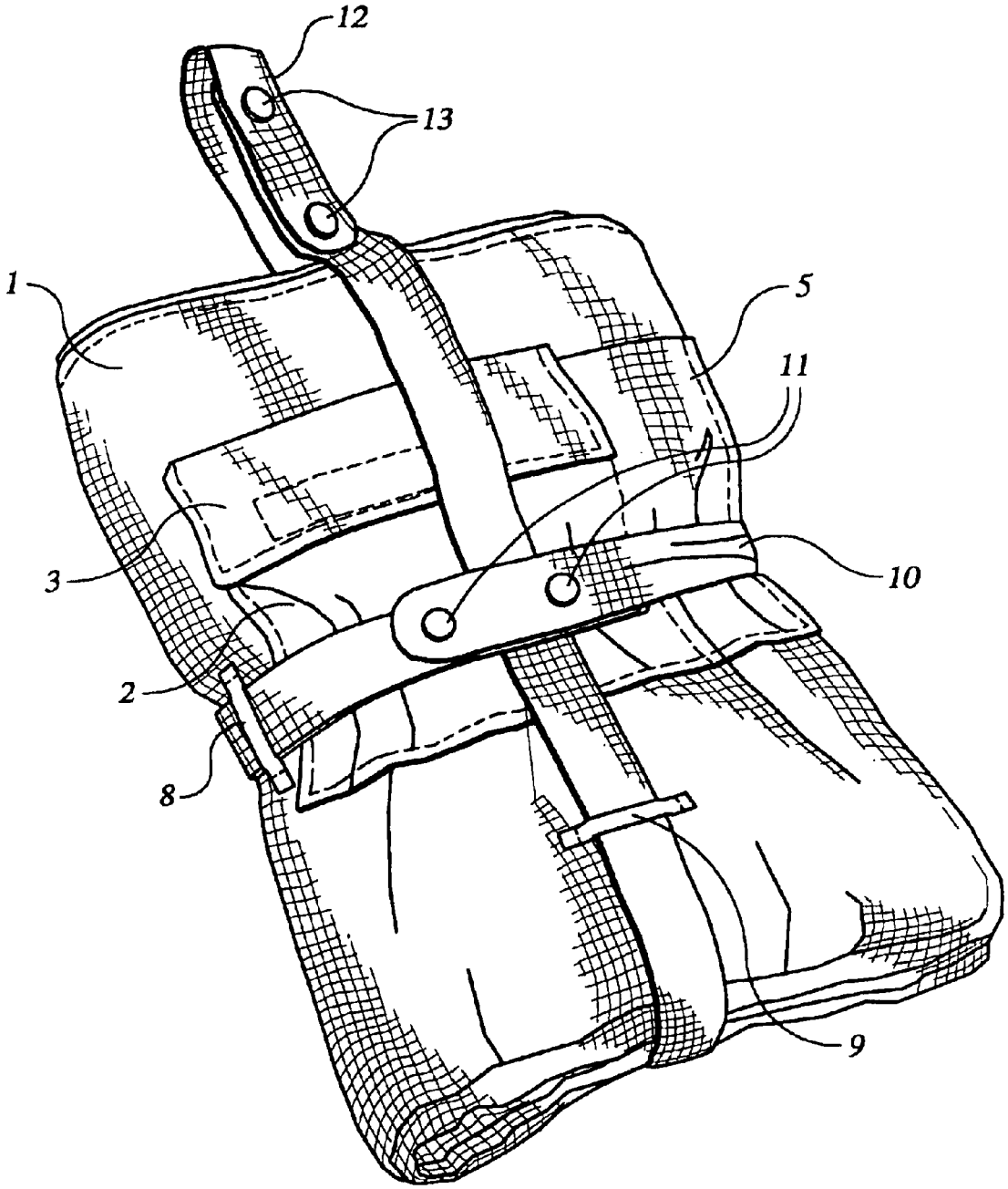

2. FIG. 2 shows in isolated perspective view the anterior aspect of the invention in a wholly folded state.

Figure 3:
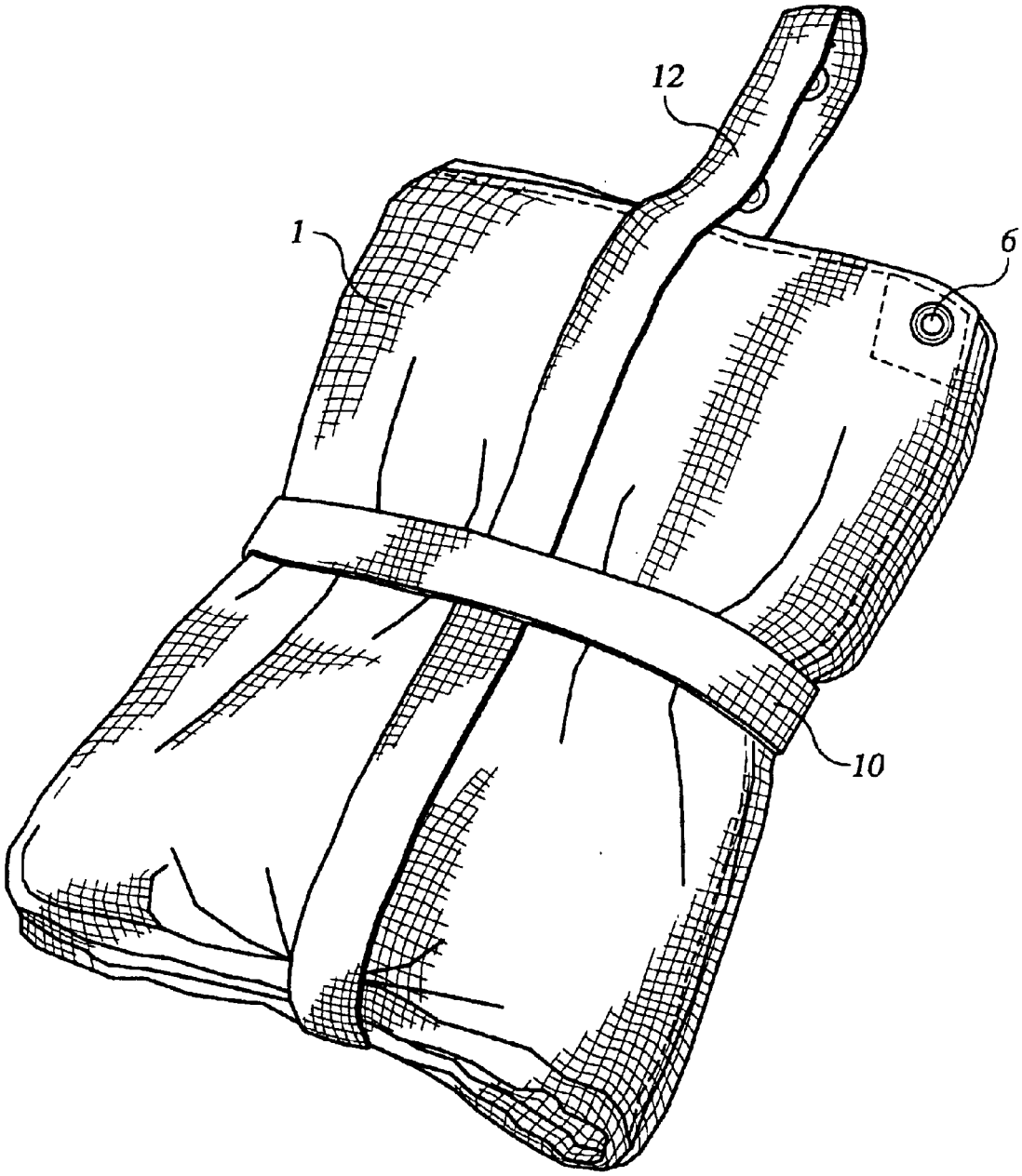

3. FIG. 3 shows an isolated perspective view of the posterior aspect of the invention in a wholly folded state.

Figure 4:
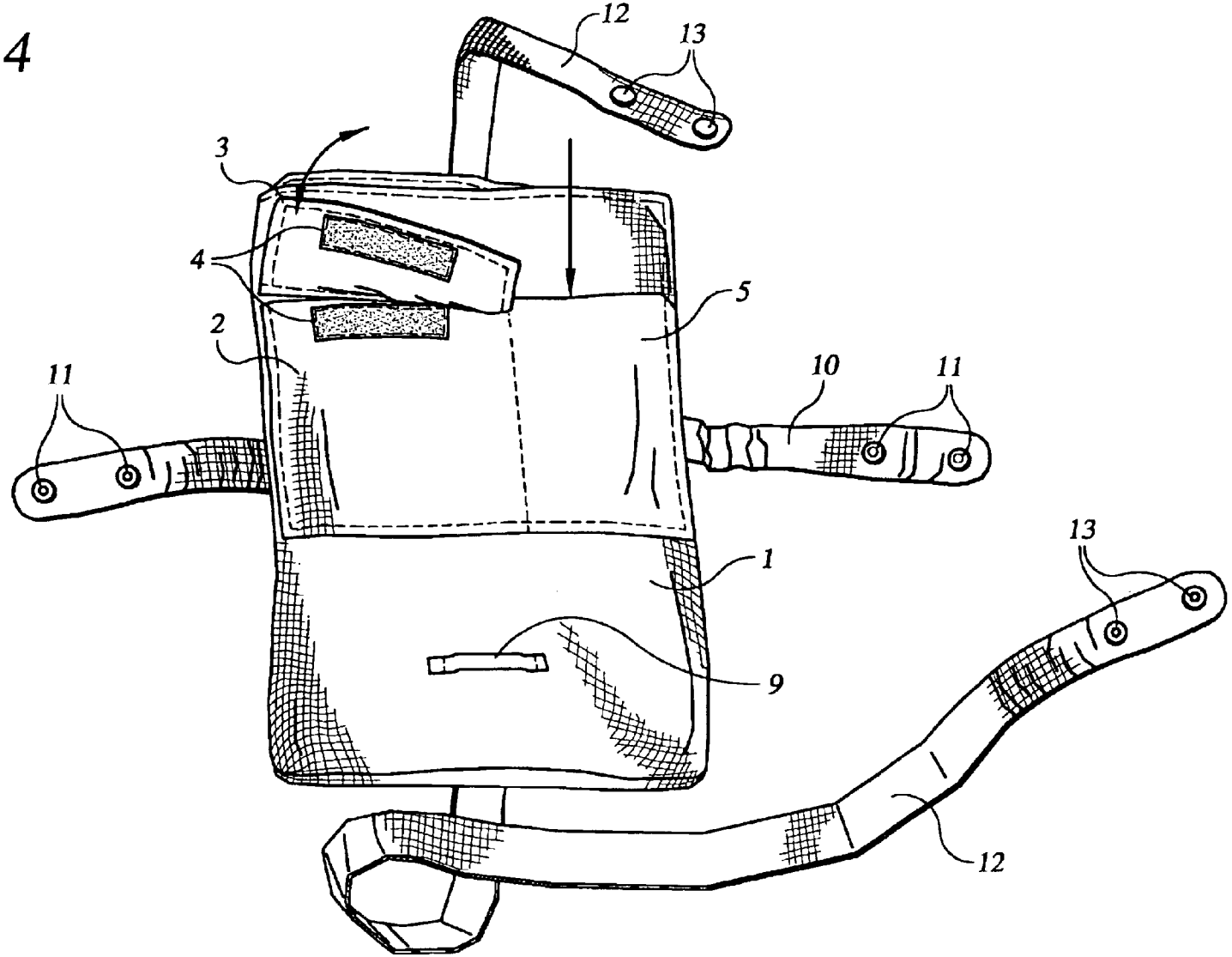

4. FIG. 4 shows the invention in a state of assembly for use.

Figure 5:
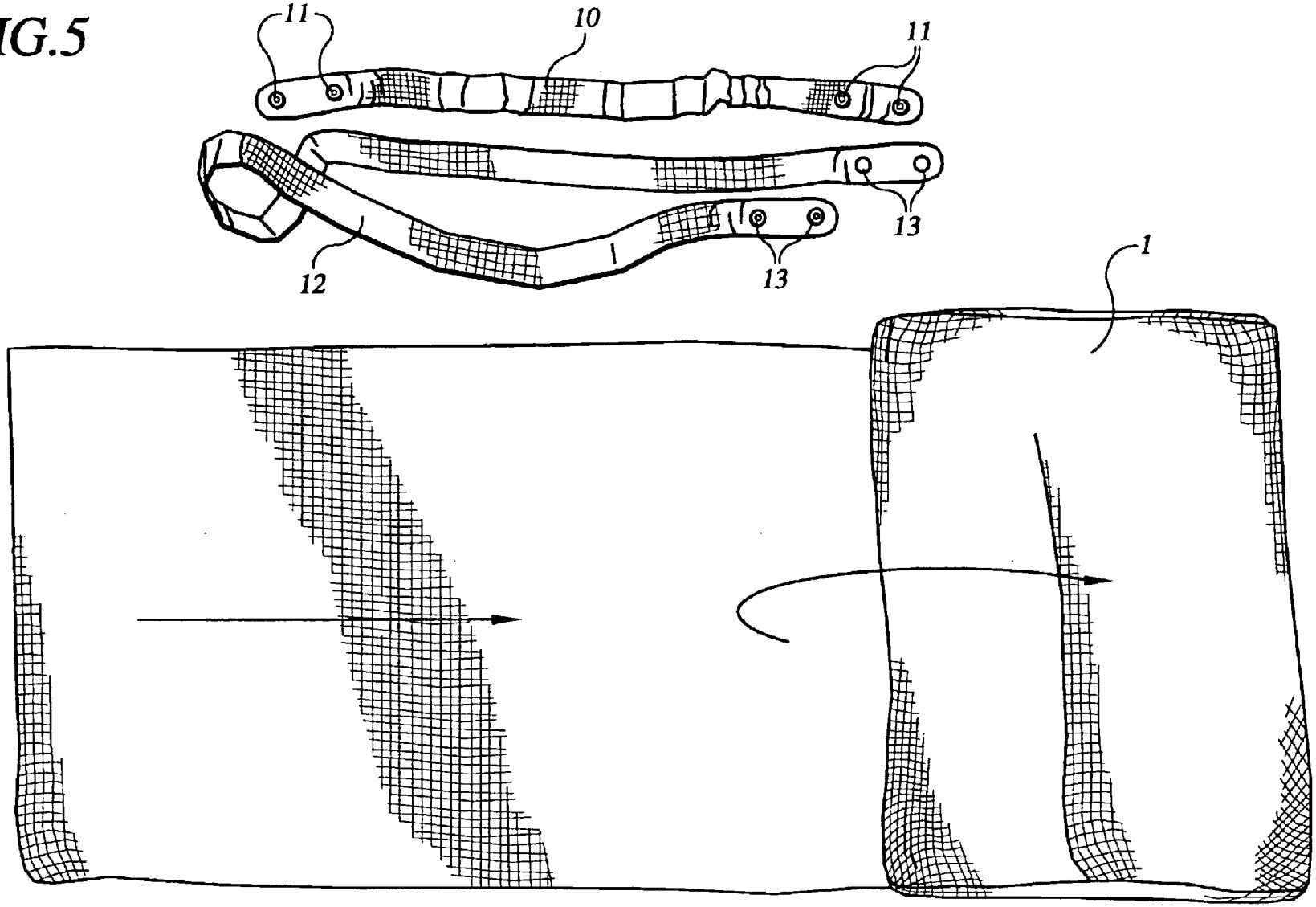

5. FIG. 5 shows the invention in an initial state of being unfolded for use.

Figure 6:
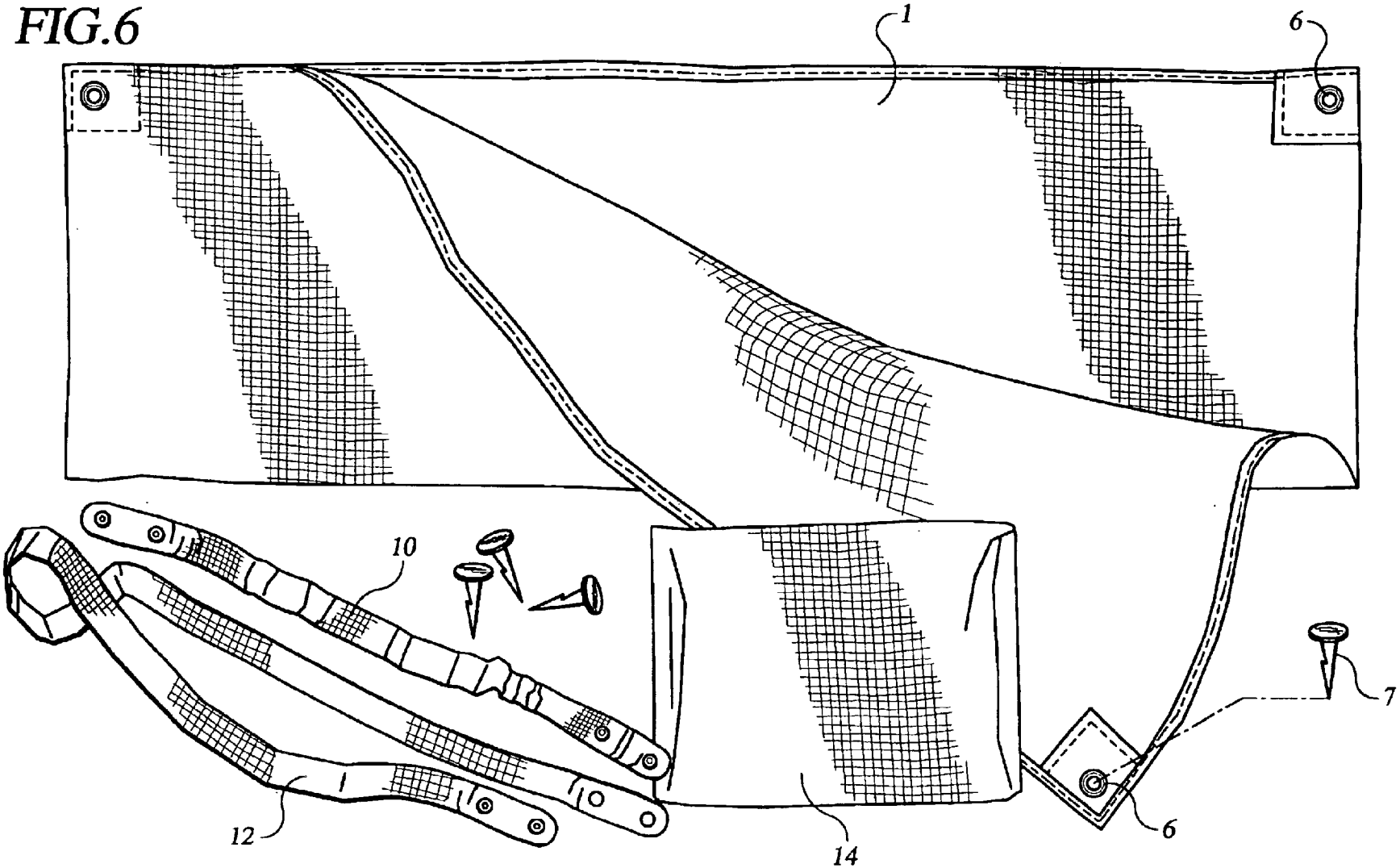

6. FIG. 6 shows the invention in a virtually wholly unfolded state.

Figure 7:
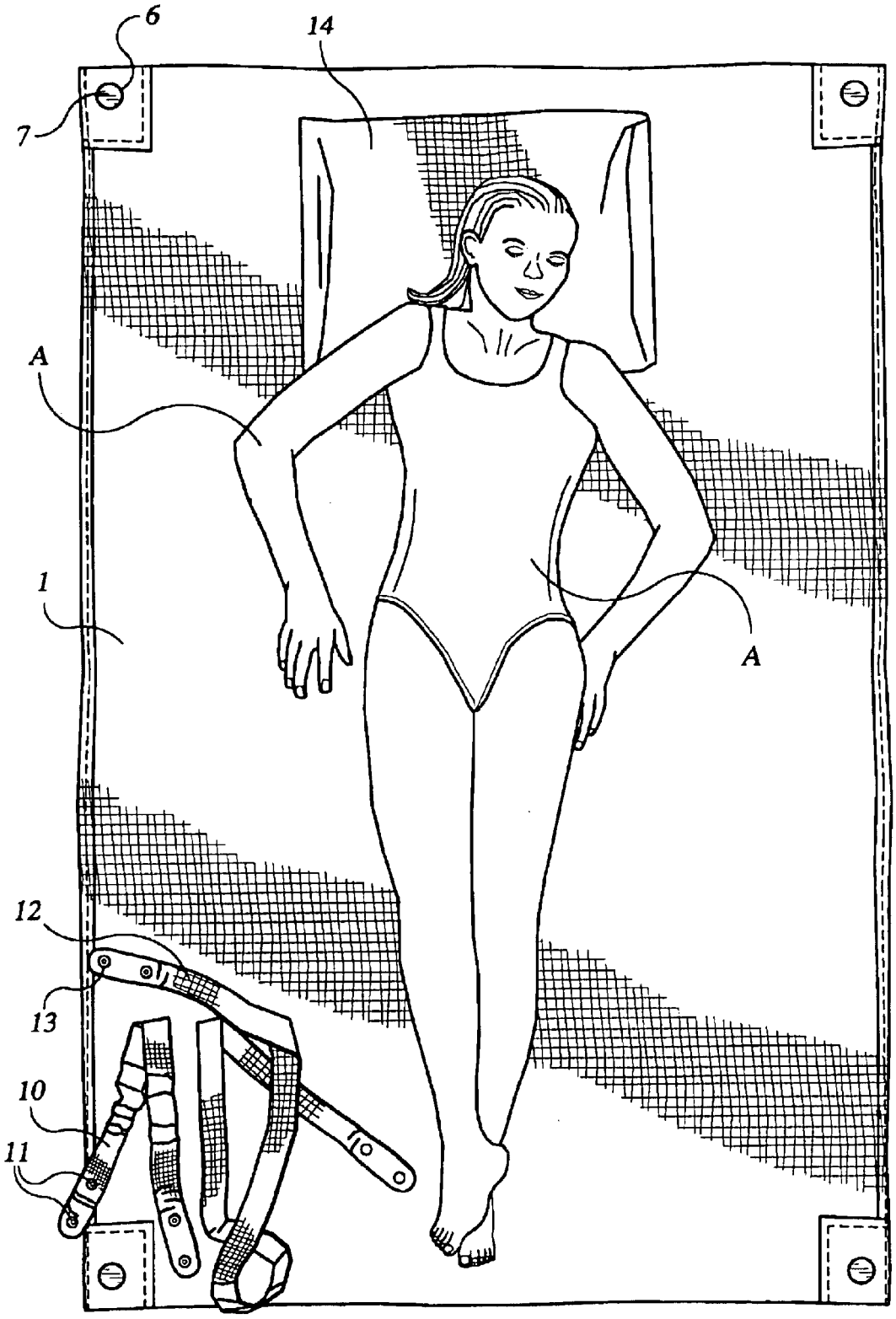

7. FIG. 7 shows the invention wholly assembled unfolded and in use by a person.

A DESCRIPTION OF THE PREFERRED EMBODIMENTS

FIG. 1 is a view showing the intact invention being transported by a person A who would be desirous of visiting a beach on, for example, a warm, sunny, summer day. FIG. 2 shows in isolated perspective view the anterior aspect of the invention and FIG. 3 shows in isolated perspective view, the posterior aspect of the invention. FIG. 4 shows the invention a state of assembly for use and FIG. 5 shows the invention in an initial state of being unfolded for use. As can be noted from FIG. 1, second strapping unit 12 conjoined at the ends thereof by second equivalent affixation means 13; which are shown as snap units but could just as easily be hook and fastener materials affixed at either end; is shown looped about the forearm of a person A. First strapping unit 10 conjoined at the ends thereof by first equivalent affixation means 11 in the same manner as with respect to second strapping unit 12 serves to along with second strapping unit 12 when each strapping unit is wrapped about towel 1 to retain towel 1 in a folded state. First strapping unit 10 is held to towel 1 via optional first strapping loop 8 sewn to towel 1, and, second strapping unit 12 is held to towel 1 via optional second strapping loop 9 also sewn to towel 1 so as to maximally prevent strapping slippage during a carrying of the invention in a folded state all as seen in FIG. 1. These features of the invention are seen in FIGS. 2 and 3 as well. In FIG. 2, one can observe flap component 3 sewn to towel 1 above pocket 2 likewise sewn to towel 1 and pocket 5 adjacent pocket 2 also sewn to towel 1. Pocket 2 carries pillow 14 which can be seen in use by person A i.e., in FIG. 7 while the invention is in a wholly folded state. Flap component 3 is optional and serves only to prevent a possible soiling of pillow 14 by the elements while the invention is being carried in a wholly folded state. Flap component 3 is held in a closed position to pocket 2 by way of flap affixation means 4 shown in FIG. 4 sewn to the outside lining of pocket 2 and the inside lining of flap component 3. Such flap affixation means 4 shown as hook and fastener materials in FIG. 4 could also be snap units as well. FIG. 6 showing the invention in a virtually wholly unfolded state illustrates equivalent pins 7 and equivalent corner holes 6 of the invention. When the invention is unfolded as per FIGS. 4, 5 and 6, then it is anchored to the sand of a beach as shown in FIG. 7 by way of inserting pins 7 one at a time into each one of the equivalent four corner holes 6 of the invention. FIG. 7 shows a person A resting atop towel 1 of the invention in a wholly unfolded state with her head on pillow 14 and with towel 1 anchored via pins 7 in holes 6 to the sand of the beach. First strapping unit 10 and second strapping 12 are shown lying upon a corner section of unfolded towel in FIG. 7. Moreover, from FIG. 7, one can clearly visualize the male-female snap units, to wit, first equivalent affixation means 11 on the ends of strapping unit 10, and second equivalent affixation means 13 on the ends of second strapping unit 12, these being the preferred means for conjoining the ends of first strapping units 10 and 12 respectively while the invention is being carried in a wholly folded state as shown in FIG. 1.

In conclusion, respectfully submitted, the ease of portability of the invention in a wholly folded state combined with its stability in such a state in view of the effects exerted by strapping units 10 and 12 conjoined as noted above together with the convenience and comfort provided to a user thereof in a wholly unfolded state as noted in FIG. 7 all operate to, respectfully submitted, render the invention as clearly being indeed new, useful and unique.

What is claimed is:

1. A portable, anchorable beach towel apparatus, comprising:

a. a towel;

b. a first towel pocket sewn to said towel;

c. a flap component sewn to said towel above said first towel pocket;

d. flap affixation means for affixing said flap component to an outer side of said first towel pocket;

e. a second towel pocket sewn to said towel;

f. four holes with there being one of said holes in each corner of said towel;

g. four pin components with one of said four pin components being inserted into each one of said holes;

h. a first strapping loop sewn to said towel;

i. a second strapping loop sewn to said towel;

j. a first strapping unit threadable through said first strapping loop and wrapable about said towel;

k. first affixation means for attaching a first end of said first strapping unit to a second end thereof;

l. a second strapping unit threadable through said second strapping loop and wrapable about said towel;

m. second affixation means for attaching a firsts end of said second strapping unit to a second end thereof;

o. said first strapping loop being sewn to said towel perpendicular to a lie of said second strapping loop as sewn to said towel;

p. a first horizontal central axis of symmetry of said first towel pocket with said towel being in a wholly folded state being then positionally coincident with a second horizontal central axis of symmetry of said second towel pocket, and;

q. said first horizontal central axis of symmetry and said second horizontal axis of symmetry being located near to and parallel with a horizontal central axis of symmetry of said towel when said towel is in a wholly folded state.

2. The portable, anchorable beach towel apparatus of claim 1 whereby said flap affixation means is hook and fastener material affixed to an inner side of said flap component and to an outer side of said first towel pocket.

3. The portable, anchorable beach towel apparatus of claim 1 whereby said flap affixation means is male-female snap units.

4. A portable, anchorable beach towel apparatus, comprising:

a. a towel;

b. a first towel pocket sewn to said towel;

c. a flap component sewn to said towel above said first towel pocket;

d. flap affixation means for affixing said flap component to an outer side of said first towel pocket;

e. a second towel pocket sewn to said towel;

f. four holes with there being one of said holes in each corner of said towel;

g. four pin components with one of said four pin components being int into each one of said holes;

h. a first strapping unit wrapable about said towel;

i. first affixation means for attaching a first end of said first strapping unit to a second end thereof;

j. a second strapping unit wrapable about said towel;

k. second affixation means for attaching a first end of said second strapping unit to a second end thereof;

l. a pillow inserted within said first towel pocket;

m. a first horizontal central axis of symmetry of said first towel pocket with said towel being in a wholly folded state being then positionally coincident with a second horizontal central axis of symmetry of said second towel pocket, and;

n. said first horizontal central axis of symmetry and second horizontal axis of symmetry being located near to and parallel with a horizontal central axis of symmetry of said towel when said towel is in a wholly folded state.

5. The portable, anchorable beach towel apparatus of claim 4 whereby said flap affixation means is hook and fastener material affixed to an inner side of said flap component and to an outer side of said first towel pocket.

6. The portable anchorable beach towel apparatus of claim 4 whereby said flap affixation means is male-female snap units.

7. A portable, anchorable beach towel apparatus, comprising:

a. a towel;

b. a first towel pocket sewn to said towel;

c. a second towel pocket sewn to said towel;

d. four holes with there being one of said holes in each corner of said towel;

e. four pin components with one of said four pin components being inserted into each one of said holes;

f. a first strapping loop sewn to said towel;

g. a second strapping loop sewn to said towel;

h. a first strapping unit threadable through said first strapping loop and wrapable about said towel;

i. first affixation means for attaching a first end of said first strapping unit to a second end towel;

j. a second strapping unit threadable though said second strapping loop and wrapable about said towel;

k. second affixation means for attaching a first end of said second strapping unit to a second end thereof;

l. a pillow inserted within said first towel pocket;

m. said first strapping loop being sewn to said towel perpendicular to a lie of said second strapping loop as sewn to said towel;

n. a first horizontal central axis of symmetry of said first towel pocket with said towel being in a wholly folded state being then positionally coincident with a second horizontal central axis of symmetry of said second towel pocket, and;

o. said first horizontal central axis of symmetry and said second horizontal axis of symmetry being located near to and parallel with a horizontal central axis of symmetry of said towel when said towel is in a wholly folded state.

8. A portable, anchorable beach towel apparatus, comprising:

a. a towel;

b. a first towel pocket sewn to said towel;

c. a second towel pocket sewn to said towel;

d. four holes with there being one of said holes in each corner of said towel;

e. four pin components with one of said four pin components being inserted into each one of said holes;

f. a fist strapping unit wrapable about said towel;

g. first affixation means for attaching a first end of said first strapping unit to a second end thereof:

h. a second strapping unit wrapable about said towel;

i. second affixation means for attaching a first end of said second strapping unit to a second end thereof;

j. a pillow inserted within said first towel pocket;

k. a first horizon central axis of symmetry of said first towel pocket with said towel being in a wholly folded state being then positionally coincident with a second horizontal central axis of symmetry of said second towel pocket, and;

said first horizontal central axis of symmetry and said second horizontal axis of symmetry being located near to and parallel with a horizontal central axis of symmetry of said towel when said towel is in a wholly folded state.

* * * * *